US010967995B1

(12) United States Patent
Hoffman et al.

(10) Patent No.: US 10,967,995 B1
(45) Date of Patent: Apr. 6, 2021

(54) INFLATABLE PACKAGING MATERIALS, AUTOMATED PACKAGING SYSTEMS, AND RELATED METHODS

(71) Applicant: Amazon Technologies, Inc., Seattle, WA (US)

(72) Inventors: Brian Hoffman, Seattle, WA (US); Alexandra Kay Hartford, Seattle, WA (US); Mohan Mahadevan, Seattle, WA (US); John Gaetano Matrecano, Sammamish, WA (US); Timothy Alan Talda, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 309 days.

(21) Appl. No.: 15/919,904

(22) Filed: Mar. 13, 2018

(51) Int. Cl.
*B65B 5/02* (2006.01)
*B65B 41/16* (2006.01)
(Continued)

(52) U.S. Cl.
CPC ..... *B65B 5/02* (2013.01); *B31D 5/0073* (2013.01); *B65B 41/16* (2013.01); *B65B 43/10* (2013.01);
(Continued)

(58) Field of Classification Search
CPC .. B31D 5/0073; B31D 5/0039; B65D 81/052; B29C 66/439; B65B 55/00; B65B 55/20;
(Continued)

(56) References Cited

U.S. PATENT DOCUMENTS 2,672,268 A * 3/1954 Bower ..... B29C 66/81431 53/79
2,962,158 A 11/1960 Struthers
(Continued)

FOREIGN PATENT DOCUMENTS

JP 01-294465 A 11/1989
WO WO 1997/003816 A1 2/1997
WO WO 2000/005149 A2 2/2000

OTHER PUBLICATIONS

U.S. Appl. No. 15/891,600, filed Feb. 8, 2018, Talda et al.
(Continued)

*Primary Examiner* — Stephen F. Gerrity
*Assistant Examiner* — Joshua G Kotis
(74) *Attorney, Agent, or Firm* — BakerHostetler

(57) ABSTRACT

A package preparation system includes a material conveyable along a longitudinal direction and including two folded layers of polymeric film joined at a fold. The fold extends longitudinally and defines a first side of the material opposite an open second side. A first welding device forms partition welds located between the two folded layers and extending from the fold to a terminus inward of the open side. A second welding device forms first and second seal welds that extend from the fold to the open side and are spaced from each other by a length extending longitudinally and traversing a plurality of the partition welds. The system includes a device comprising a nozzle insertable in the open side, and clamps that traverse the length and temporarily seal the open side around the nozzle while the nozzle inflates interior channels defined between the plurality of partition welds.

11 Claims, 10 Drawing Sheets

(51) Int. Cl.

| | |
|---|---|
| ***B65B 47/04*** | (2006.01) |
| ***B65B 51/22*** | (2006.01) |
| ***B65B 43/10*** | (2006.01) |
| ***B31D 5/00*** | (2017.01) |
| ***B65B 55/20*** | (2006.01) |
| *B65B 5/06* | (2006.01) |
| *B65B 57/00* | (2006.01) |

(52) U.S. Cl.
CPC ..... *B65B 47/04* (2013.01); *B65B 51/225* (2013.01); *B65B 55/20* (2013.01); *B65B 5/06* (2013.01); *B65B 57/00* (2013.01)

(58) Field of Classification Search
CPC ..... B65B 5/022; B65B 47/04; B65B 51/26; B65B 51/225; B65B 51/227; B65B 51/16
USPC ..... 206/522; 156/145; 53/79, 403, 455, 472, 53/562, 434, 512; 383/3; 493/967
See application file for complete search history.

(56) References Cited

U.S. PATENT DOCUMENTS

| | | | | |
|---|---|---|---|---|
| 3,303,629 | A | 2/1967 | Tobin | |
| 3,762,629 | A | 10/1973 | Bruno | |
| 38,678,741 | | 2/1975 | O'Neil | |
| 3,906,128 | A | 9/1975 | Burling et al. | |
| 4,011,798 | A | 3/1977 | Bambara et al. | |
| 4,087,002 | A | 5/1978 | Bambara et al. | |
| 4,105,724 | A | 8/1978 | Talbot | |
| 4,253,892 | A | 3/1981 | D'Angelo et al. | |
| 4,265,956 | A | 5/1981 | Colijn | |
| 4,297,154 | A | 10/1981 | Keller | |
| 4,832,228 | A | 5/1989 | Hickey | |
| 4,921,118 | A | 5/1990 | Gass | |
| 4,928,829 | A * | 5/1990 | Di Bernardo | B65B 31/06 206/524.8 |
| 5,030,501 | A | 7/1991 | Colvin et al. | |
| 5,207,020 | A | 5/1993 | Aslam et al. | |
| 5,651,402 | A * | 7/1997 | McCaul | A63H 27/10 141/114 |
| 5,667,871 | A | 9/1997 | Goodrich et al. | |
| 6,089,325 | A | 7/2000 | Yassin Alhamad | |
| 6,800,162 | B2 * | 10/2004 | Kannankeril | B29C 65/18 156/145 |
| 6,898,922 | B2 | 5/2005 | Reist | |
| 7,128,211 | B2 * | 10/2006 | Nishi | B31D 5/0073 206/522 |
| 7,200,974 | B2 * | 4/2007 | Higer | B65B 31/048 53/512 |
| 7,220,476 | B2 * | 5/2007 | Sperry | B31D 5/0073 206/522 |
| 7,223,461 | B2 * | 5/2007 | Kannankeril | B31D 5/0073 206/522 |
| 7,240,468 | B2 * | 7/2007 | Tanaka | B31D 5/0073 53/115 |
| 7,658,543 | B2 | 2/2010 | Shiokawa et al. | |
| 7,669,386 | B2 * | 3/2010 | Liao | B31D 5/0073 53/96 |
| 8,919,689 | B2 | 12/2014 | Kuchar et al. | |
| 9,266,300 | B2 * | 2/2016 | Chuba | B29D 22/02 |
| 9,315,319 | B2 * | 4/2016 | Maxwell | B65F 1/0006 |
| 9,586,747 | B2 | 3/2017 | Zhang | |
| 9,649,823 | B2 | 5/2017 | Prud'homme et al. | |
| 9,827,711 | B2 | 11/2017 | Wetsch et al. | |
| 9,969,136 | B2 * | 5/2018 | Lepine | B29D 22/02 |
| 10,002,692 | B2 | 6/2018 | Czyzewski et al. | |
| 10,301,121 | B1 | 5/2019 | Hoffman et al. | |
| 10,647,460 | B2 * | 5/2020 | Wehrmann | B31D 5/0073 |
| 2004/0000581 | A1 | 1/2004 | Brandolini et al. | |
| 2008/0020188 | A1 | 1/2008 | Gale | |
| 2014/0130461 | A1 * | 5/2014 | Johan | B65B 43/123 53/468 |
| 2015/0314936 | A1 | 11/2015 | Stack, Jr. | |
| 2016/0067938 | A1 | 3/2016 | Goodrich | |
| 2017/0203866 | A1 | 7/2017 | Goodrich | |
| 2018/0370702 | A1 | 12/2018 | Goodrich | |
| 2019/0100369 | A1 | 4/2019 | Hoffman et al. | |

OTHER PUBLICATIONS

U.S. Appl. No. 16/147,160, filed Sep. 28, 2018, Hoffman.
U.S. Appl. No. 16/147,073, filed Sep. 28, 2018, Hoffman.
U.S. Appl. No. 15/720,538, filed Sep. 29, 2017, Hoffman et al.
U.S. Appl. No. 15/655,318, filed Jul. 20, 2017, Hoffman et al.
International Patent Application No. PCT/US2018/053372; Int'l Search Report and the Written Opinion; dated Nov. 30, 2018; 13 pages.

* cited by examiner

INFLATABLE PACKAGING MATERIALS, AUTOMATED PACKAGING SYSTEMS, AND RELATED METHODS

BACKGROUND

In an order fulfilment center, automated induction of random items into flexible packaging, such as flexible envelopes, for the shipment and/or delivery of single-item or multi-item orders presents significant challenges. These challenges are compounded in fulfillment centers that process items having varying sizes, shapes, and cushioning and/or protection requirements. In current automated packaging systems, if preformed packages, such as standard-sized padded mailers, are used, then packaging volumes greater than what is necessary to package single-item or multi-item orders often result, leading to wasteful shipping volumes and unnecessary transportation costs. Furthermore, even when on-demand, size-customizable padded packaging materials are employed, such as bubble-wrap, a single roll of such padded materials occupies significantly more volume than that a single roll of un-inflated roll stock material. Furthermore, certain padded packaging materials, such as bubble-wrap, require deforming the constituent polymer film during bubble formation, which precludes the use thereof of certain polymeric materials that are otherwise suitable for use in a package, such as plant-based biofilms, for example.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

The embodiments disclosed herein pertain to systems, devices, and methods for packaging one or more items in a customizable, inflated packaging cushion. In particular, as described below with reference to FIGS. 1-16, systems, devices, and methods are set forth for preparing customizable, inflated packaging cushions that are shaped for receiving items therein. As described below with reference to FIGS. 17-20, systems, devices, and methods are set forth for inducting items into the inflated, shaped packaging cushions, and sealing the items therein so as to form enclosed, sealed packages containing the items.

Figure 1:
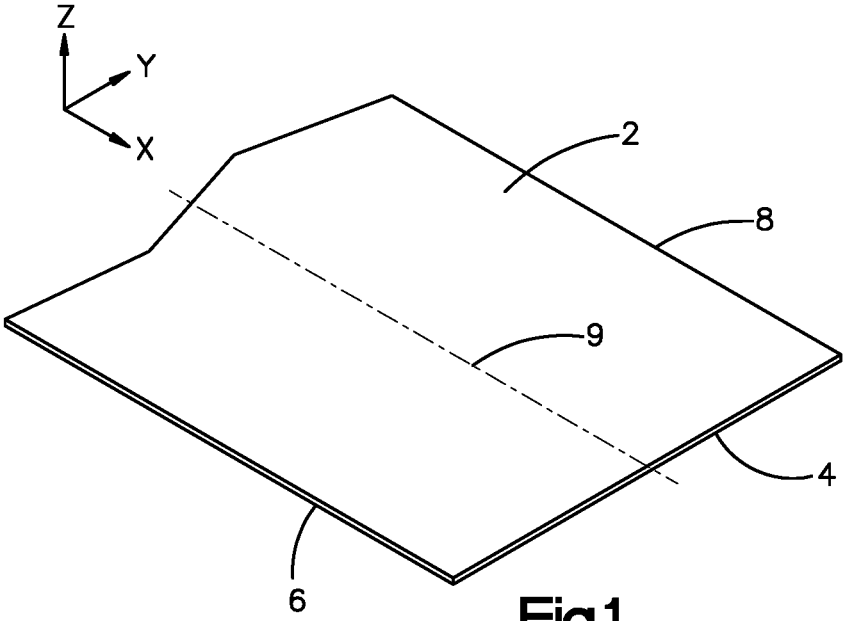
FIG. 1 shows a perspective view of an inflatable, size-customizable packaging material at a first stage for preparing a package with the packaging material, according to an embodiment of the present disclosure.

Referring now to FIG. 1, at a first stage for preparing a package, a layer of packaging material 2 can be conveyed in a direction of conveyance X, which can also be characterized as the longitudinal direction. The layer of packaging material 2 can also be termed a "length", "line", or a "belt" of packaging material 2, and can be conveyed in the direction of conveyance X by one or more rollers or other mechanisms for conveying a line of material. The packaging material 2 can define a leading end 4 extending along a lateral direction Y that is substantially perpendicular to the direction of conveyance X. The packaging material 2 can also define first and second opposed lateral sides 6, 8 spaced from each other along the lateral direction Y, and a longitudinal axis 9 extending along the direction of conveyance X. The longitudinal axis 9 defines a lateral midline of the layer of packaging material 2.

The packaging material 2 can define a thickness in a vertical direction Z substantially perpendicular to the conveyance and lateral directions X, Y. It is to be appreciated that, as used herein, the terms "longitudinal" and "longitudinally" mean "along the longitudinal direction" (i.e., "along the direction of conveyance X"); the terms "lateral" and "laterally" mean "along the lateral direction Y"; and the terms "vertical" and "vertically" mean "along the vertical direction Z". The packaging material 2 can be any flexible or pseudo-flexible packaging grade material that is non-permeable to air. In some embodiments, the packaging material 2 comprises a polymeric material, such as a plastic and/or a polymer biofilm (also referred to herein as simply a "biofilm" or a "bioplastic"), for example. Biofilms are made entirely, primarily, or at least partially from materials derived from biological sources, such as, by way of non-limiting examples, sugarcane, potato starch, or the cellulose from trees and straw. Biofilms provide certain advantages for packaging materials based on their ability to biodegrade or compost at the conclusion of their useful life, which processes can be assisted by bacteria, enzymes, and even fungi. Additionally, biofilms can generally be substituted for their oil-based counterparts, and can be made to be chemically identical (or at least virtually identical) to standard industrial plastics. One such biofilm that can be employed as the packaging material is cellulose acetate, by way of non-limiting example. In other embodiments, the packaging material 2 can comprise rubber, latex, mylar nylon, polymer films (such as low-density polyethylene (LDPE), high-density polyethylene (HDPE), or an LDPE/HDPE blend), or even metallic and paper materials. Relative to some polymer films, some biofilms have properties that present a challenge in terms of manipulation. For example, some biofilms, such as cellulous acetate, are difficult to stretch and/or blow mold.

Figure 2:
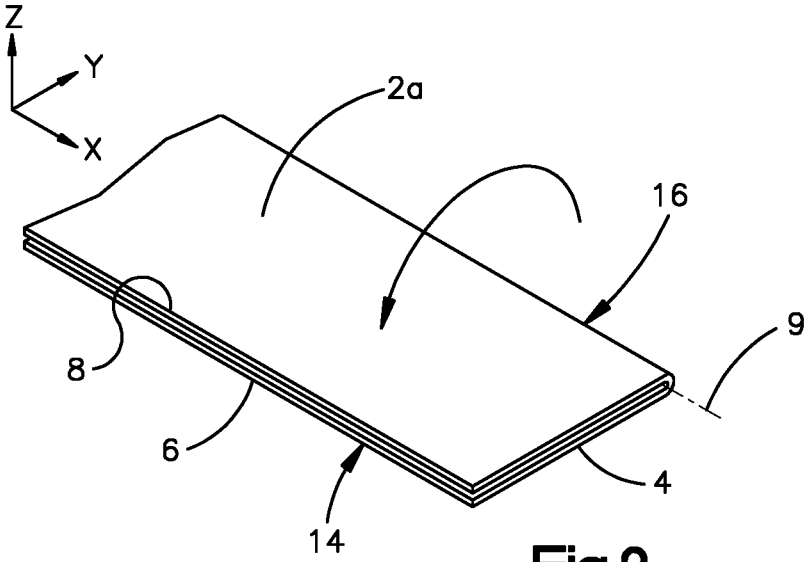
FIG. 2 shows a perspective view of the packaging material of FIG. 1 at a second stage for preparing a package with the packaging material.
Figure 3:
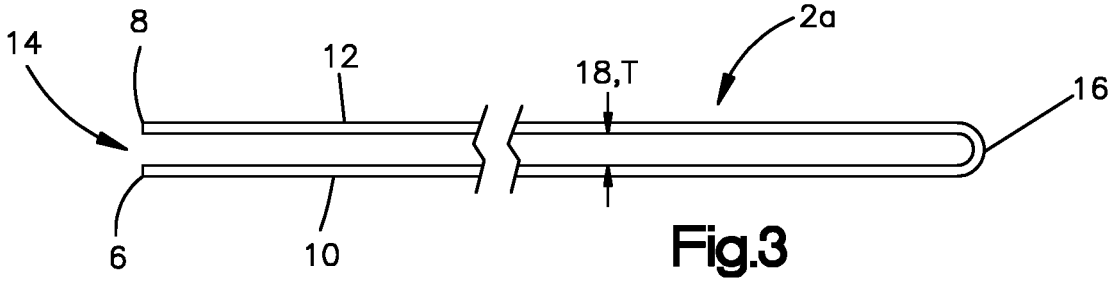
FIG. 3 shows and end view of the packaging material of FIG. 2.

Referring now to FIGS. 2 and 3, at a second stage for preparing a package, the packaging material 2 can be folded about a lateral midline 9 of the material 2 so that the lateral sides 6, 8 are substantially aligned with one another along the vertical direction Z. In this manner, the packaging material 2 can define a folded packaging material 2*a*, which can also be characterized as a double-layer, multi-layer, or inner/outer-layer packaging material 2*a*. The lower layer of the folded packaging material 2*a* can be characterized as a first layer 10 and the upper layer can be characterized as a second layer 12. The adjacent lateral sides 6, 8 can define an open side 14 of the packaging material 2*a* that is laterally opposite a folded side 16 of the packaging material 2*a*. The folding can be accomplished by one or more folding mechanisms (see FIG. 16 below) employed in the art, and can be accomplished while the packaging material 2 is being conveyed in the direction of conveyance X. The folding can also be accomplished so that a gap 18 is maintained between the folded layers 10, 12. For example, the folded packaging material 2*a* can be conveyed along a guide that temporarily extends within the gap 18 between the folded layers 10, 12 so as to define and maintain a thickness T of the gap 18.

Figure 4:
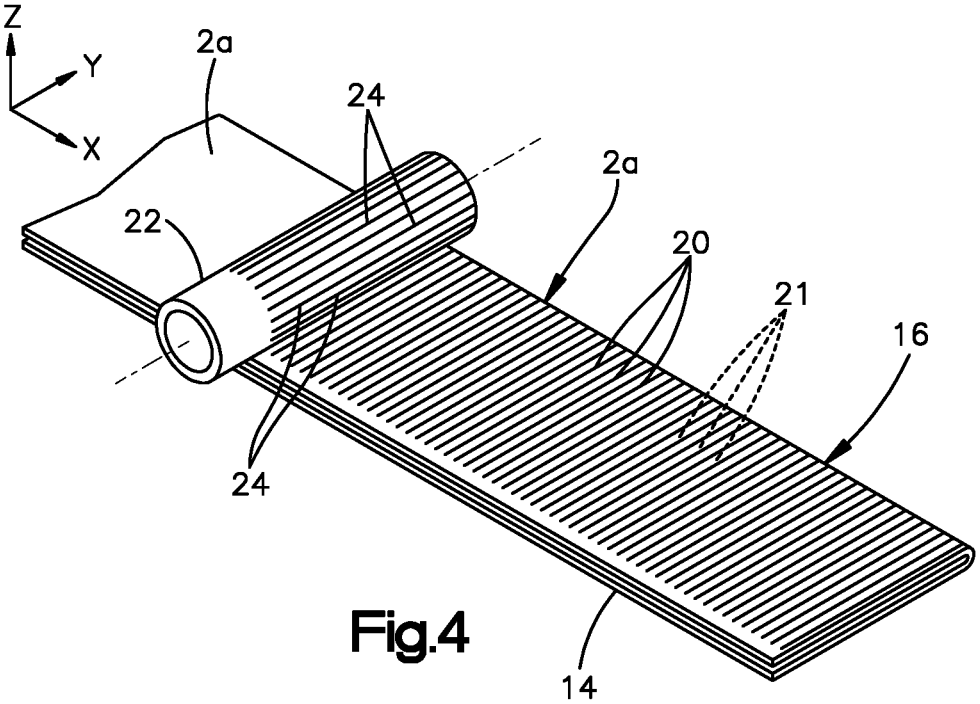
FIG. 4 shows a perspective view of the packaging material of FIGS. 1-3 at a third stage for preparing a package with the packaging material, wherein transverse channels are formed in the packaging material for subsequent inflation.
Figure 5:
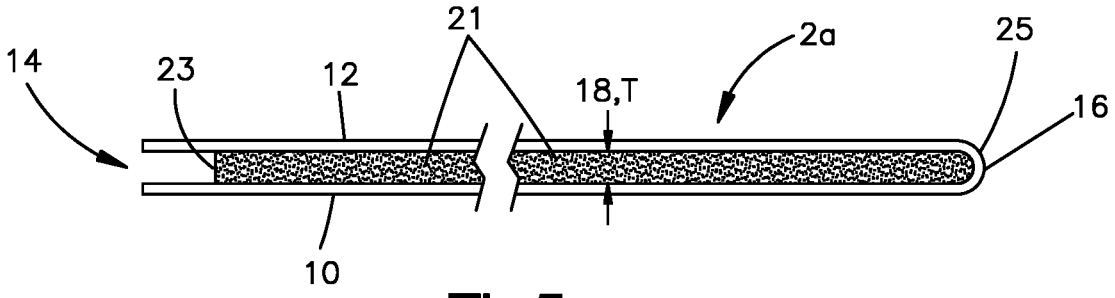
FIG. 5 shows an end view of the packaging material of FIG. 4.

Referring now to FIGS. 4 and 5, at a third stage for preparing a package, a plurality of partitions 20 can be formed vertically between the folded layers 10, 12, such as by sealing, for example. In such embodiments, the partitions 20 can be in the form of ultrasonic, friction, or thermal seals formed between the folded layers 10, 20. It is to be appreciated that the foregoing seals can also be characterized as "welds," as they are formed from transforming a portion of the packaging material 2 into a liquid state which subsequently solidifies in a manner forming the seal. Accordingly, the partitions 20 can be characterized as "welds" or "partition welds." It is to be appreciated that, as used herein, the terms "weld" and "welding" are synonymous with the terms "seal" and "sealing." The partitions 20 extend along the lateral direction Y between the open side 14 and the folded side 16 of the packaging material 2*a*. The partitions 20 extend laterally from a first terminus 23 located laterally inwardly from the open side 14 to a second terminus 25 joined with the fold 16; although in other embodiments the partitions 20 can terminate at a location inwardly offset from the fold 16. The partitions 20 define a series of longitudinally spaced, laterally elongated channels 21 extending between the folded layers 10, 12. In the illustrated embodiment, the channels 21 are closed at the fold 16 and open toward the open side 14 of the packaging material 2*a*.

In the illustrated embodiment, the partitions 20 are welds that are formed by a weld mechanism, such as a weld roller 22 (which can be a first weld roller 22) having a plurality of laterally extending welders 24 disposed along an outer circumference of the weld roller 22. In such embodiments, the folded packaging material 2*a* can be conveyed into engagement with the outer circumference of the weld roller 22. The welders 24 can be ultrasonic welders, heating elements, or other types of thermal welders, by way of non-limiting examples. It is to be appreciated that the weld mechanism is not limited to the weld roller 22 depicted, but can employ various other types of welding mechanisms, such as one or more articulating robotic arms, by way of non-limiting example. Welding can be used for a wide range of materials, including biofilms that are otherwise difficult to stretch and/or blow mold.

Figure 6:
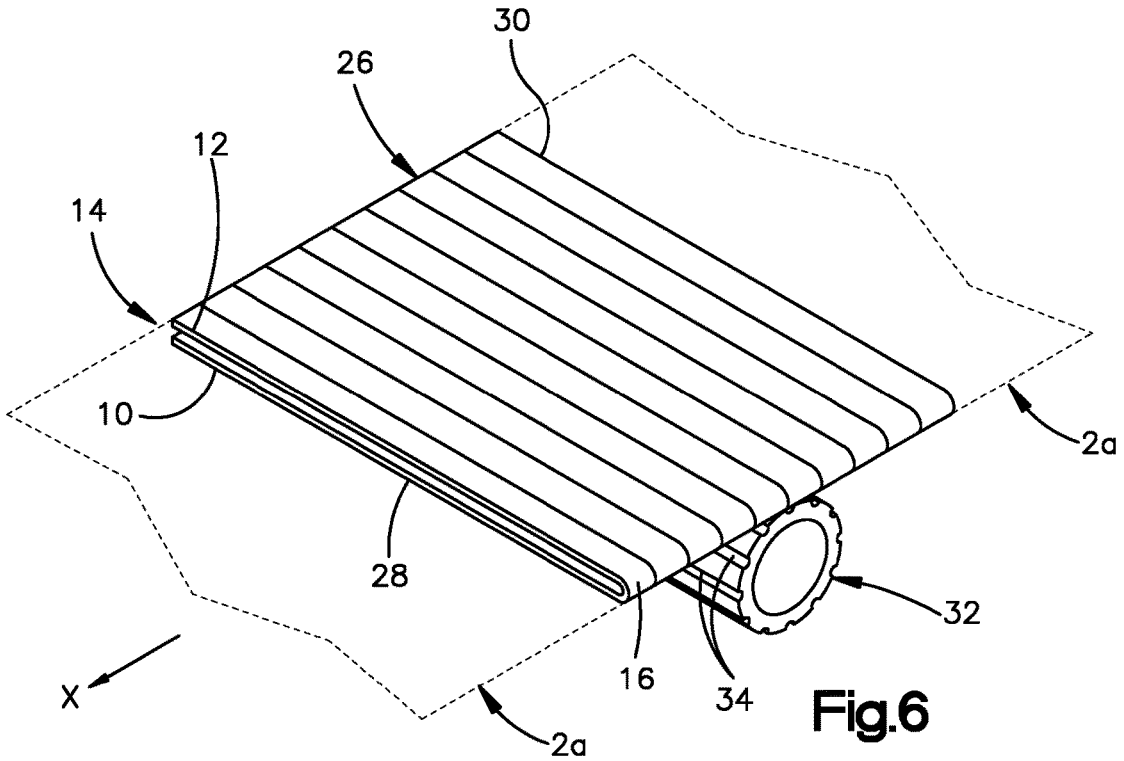
FIG. 6 shows a perspective view of the packaging material of FIGS. 1-5 at a fourth stage for preparing a package with the packaging material, wherein a segment of the packaging material is individualized and the leading and trailing edges of the segment are sealed.

Referring now to FIG. 6, at a fourth stage for preparing a package, the packaging material 2*a* can be formed into individual package segments 26 by sealing a leading end 28 and a trailing end 30 thereof. Preferably, the leading and trailing ends 28, 30 are both sealed completely from the open side 14 to the fold 16. The leading and trailing ends 28, 30 can be sealed by welding the lower and upper layers 10, 12 together at the ends 28, 30 in a manner similar to that set forth above with reference to formation of the partition welds 20. For example, as shown, the leading and trailing ends 28, 30 of the package segments 26 can be sealed by an additional sealing device, such as a second weld roller 32 carrying additional welders 34 in engagement with the packaging material 2*a*. However, as above, other types of welding mechanisms can be employed to seal the leading and trailing ends 28, 30 of the package segments 26, including those types described above. By sealing the leading and trailing ends 28, 30 from the open side 14 to the fold 16, the open side 14 of each package segment 26 remains the only open portion of the package segment 26. It is to be appreciated that, although FIG. 6 depicts a single package segment 26, the package segment 26 can remain coupled in sequence to one or more additional package segments 26 on the leading and/or trailing side 28, 30 thereof. In other embodiments, package segments 26 can be severed from line of packaging material 2*a*, such as via one or more cutting elements, such as blades, that cut along the leading and trailing ends 28, 30, by way of a non-limiting example. It is also to be appreciated that the longitudinal distance between the leading and trailing ends 28, 30 need not be equivalent for each package segment 26. For example, the second weld roller 32 can be configured to activate selected ones of the additional welders 34 to define the various longitudinal lengths of the package segments 26 as desired.

Figure 7:
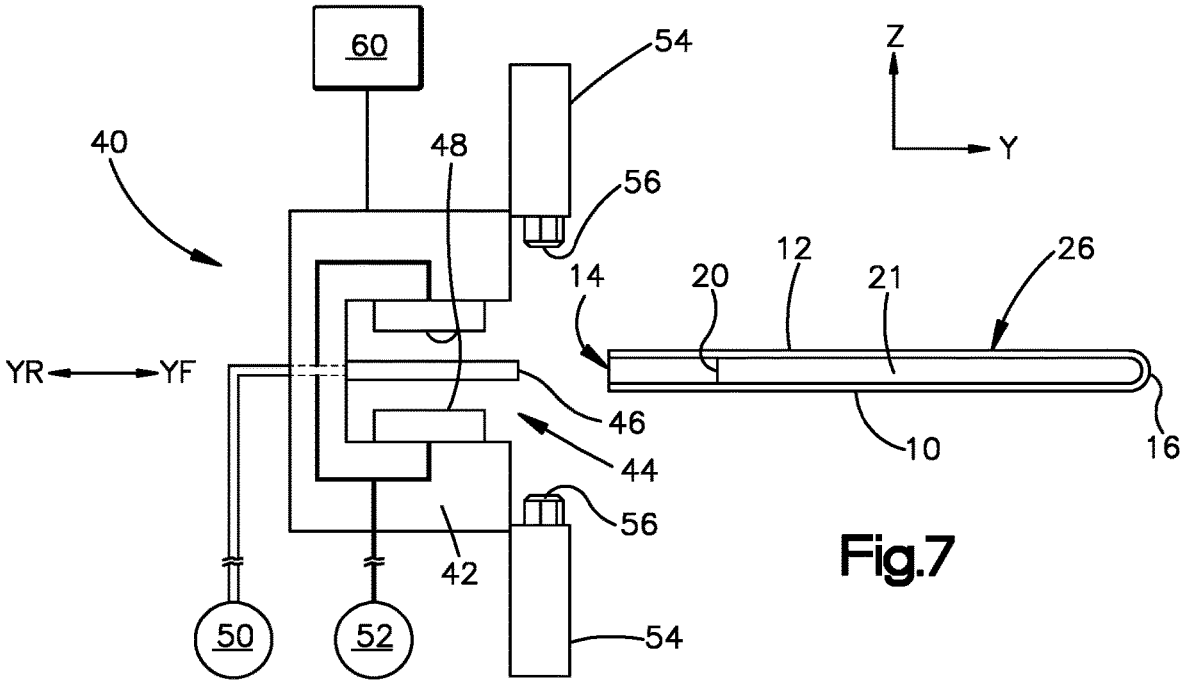
FIG. 7 shows an end view of the packaging material of FIGS. 1-6 at a fifth stage for preparing a package with the packaging material, at which stage the packaging material is conveyed adjacent a device for inflating and sealing the packaging material of FIG. 6, according to an embodiment of the present disclosure.

Referring now to FIG. 7, at a fifth stage for preparing a package, the open side 14 of the package segment 26 can be conveyed alongside a device 40 for inflating and sealing the inflated package segment 26. The device 40 is preferably configured to move at least along a "forward" lateral direction YF and an opposite "rearward" lateral direction YR to engage and disengage the open side 14 of the package segment 26, as described in more detail below. The device 40 can include a housing 42 that defines a space 44 configured to receive the open side 14 of the package segment 26. The device 40 includes a nozzle 46 positioned within the space 44, and a pair of opposed clamps 48 disposed in the space 44. The nozzle 46 extends in the forward lateral direction YF from the housing 42 toward the open side 14 of the package segment 26. The nozzle 46 is in fluid communication with a fluid supply 50, such as a container of compressed air. The clamps 48 are configured to move vertically toward one another to press the lower and upper layers 10, 12 at the open side 14 of the package segment 26 together into sealing engagement, and also to sealingly engage around the periphery of the nozzle 46. In the illustrated embodiment, the clamps 48 are inflatable bladder or "pillow" clamps that are configured to conform to the shape of the nozzle 46. Accordingly, in such embodiments, the clamps 48 are in fluid communication with a pillow fluid supply 52, such as compressed air, water, or another hydraulic fluid. However, other clamp types are within the scope of the present disclosure.

The device 40 includes a pair of opposed sealing jaws 54 located laterally forward of the clamps 48. The sealing jaws 54 each carry a sealing element 56 on an inner side thereof. The sealing jaws 54 are configured to move toward one another to bring the sealing elements 56 into engagement with the lower and upper layers 10, 12 at the open side 14 of the package segment 26, for sealing the open side 14 thereof. The sealing elements 56 carried by the jaws 54 can be ultrasonic, friction, or thermal welders, although in other embodiments the sealing elements 56 can be compression-type sealers, such as crimpers or the like. Preferably, the sealing elements 56 are shaped to extend forwardly around the distal end of the nozzle 46. In this manner, the nozzle 46 remains within the package segment 26 until the jaws 54 are retracted. The device 40 can be in electronic communication with a control unit 60 for controlling operation of the device, including forward and rearward lateral movement, operation of the pillow clamps 48, injection of air through the nozzle 46, and operation of the jaws 54 and the sealing elements 56.

With reference to FIGS. 8-13, a process for inflating and sealing the package segment 26 with the device 40 will be described.

Figure 8:
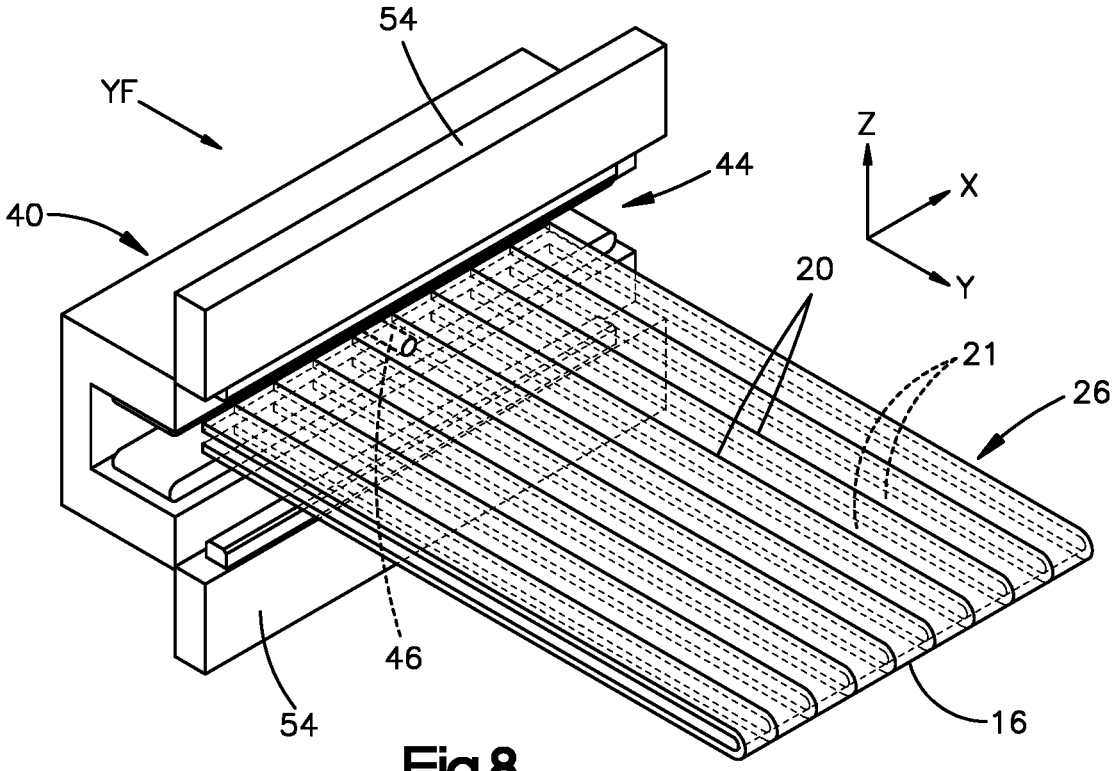
FIG. 8 shows a perspective view of the packaging material of FIGS. 1-7 at a sixth stage for preparing a package with the packaging material, at which stage the packaging material is shown at a first phase of engagement with the inflation and sealing device of FIG. 7.
Figure 9:
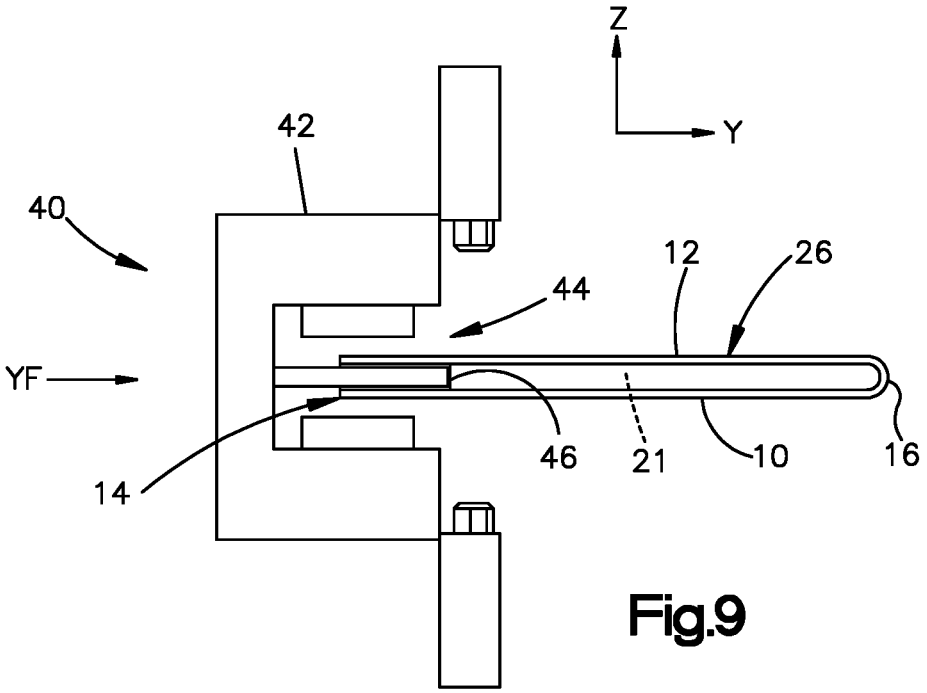
FIG. 9 shows an end view of the package preparation system of FIG. 8.

Referring now to FIGS. 8 and 9, at a sixth stage for preparing a package (which corresponds to a first phase of engagement with the device 40), the device 40 is moved laterally forward YF so that the open side 14 of the package segment 26 is received with the space 44 defined by the housing 42 and the nozzle 46 extends within the open side 14 of the package segment 26.

Figure 10:
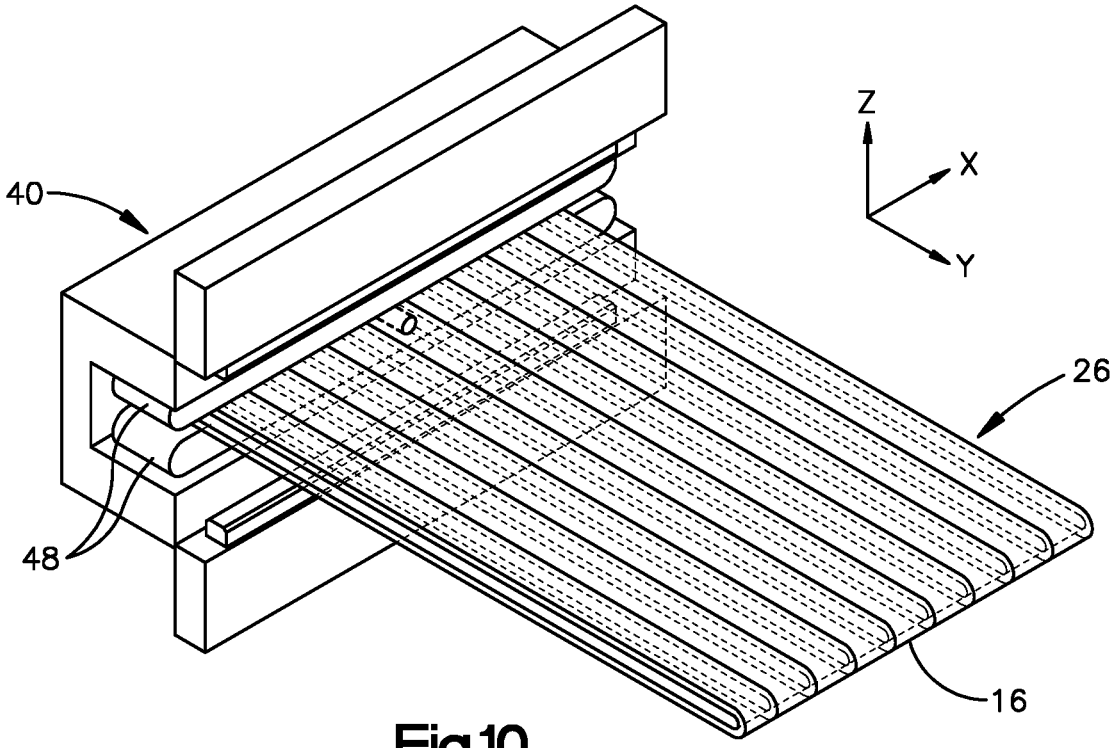
FIG. 10 shows a perspective view of the packaging material of FIGS. 1-9 at a seventh stage for preparing a package with the packaging material, at which stage the packaging material is shown at a second phase of engagement with the inflation and sealing device of FIG. 7.
Figure 11:
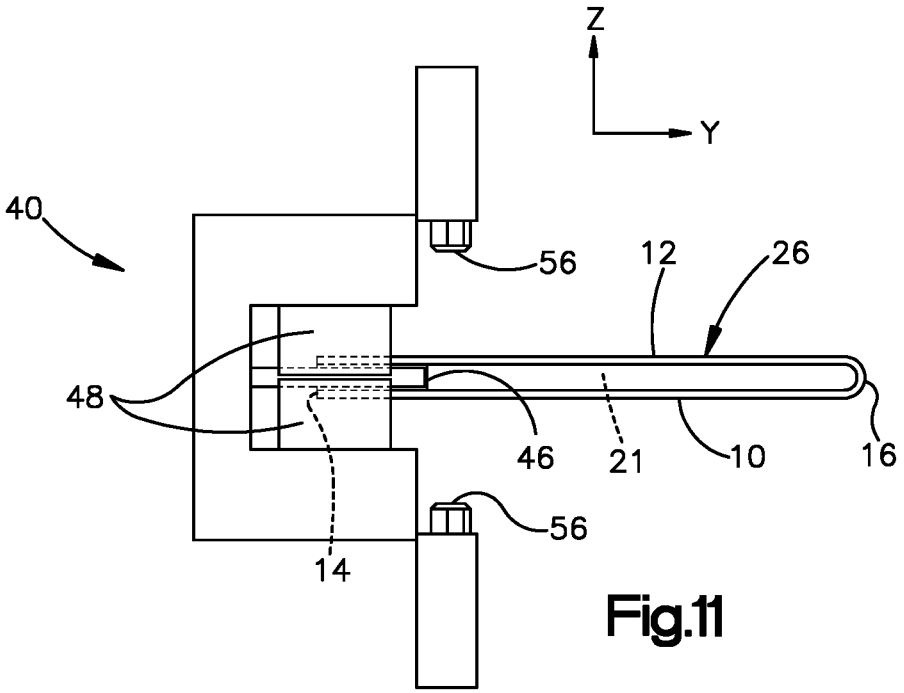
FIG. 11 shows an end view of the package preparation system of FIG. 10.

Referring now to FIGS. 10 and 11, at a seventh stage for preparing a package (which corresponds to a second phase of engagement with the device 40), the opposed pillow clamps 48 are inflated so that they move vertically toward one another and press the lower and upper layers 10, 12 at the open side 14 of the package segment 26 together into temporary sealing engagement with each other and around the periphery of the nozzle 46. During this phase, compressed air is injected through the nozzle 46 and into the temporarily sealed interior of the package segment 26. It is to be appreciated that the device 40 can be configured to inject a variable amount of air into the interior of the package segment 26, as controlled by the control unit 60, to provide varying amounts of pressure within the chambers. The level of pressure within the chambers can be based on any of a number of factors, including the item(s) designated for packaging via the package segment 26, as set forth in more detail below. For example, individual items and/or groupings of individual items to be packaged together can be categorized on a fragility index. In one non-limiting example, such a fragility index can include three (3) protection classifications: 1) "No Protection"; 2) "Intermediate Protection"; and "Maximum Protection". The control unit 60 can be configured to cause the device 40 to inject different amounts of air into the package segment 26 based on the protection classification assigned to the item(s) to be packaged therein. For a "No Protection" classification, the device 40 can inject no air into the package segment 26 and vacuum seal. For an "Intermediate Protection" designation, the device 40 can inject a selected intermediate amount of air into the package segment 26. For a "Maximum Protection" designation, the device 40 can inject a selected maximum amount of air into the package segment 26. In this manner, the inflation cushioning of each package segment 26 can be customized according to the desired protection qualities of the item(s) to be packaged therein. Adjusting inflation according to the protection requirements balances the costs associated with a relatively larger, highly inflated package, and the costs associated with "returns" for damaged products. In other words, a larger package costs more to ship, but if the larger package provides needed extra protection to avoid product damage that would result in a return, that additional cost is justified.

Figure 12:
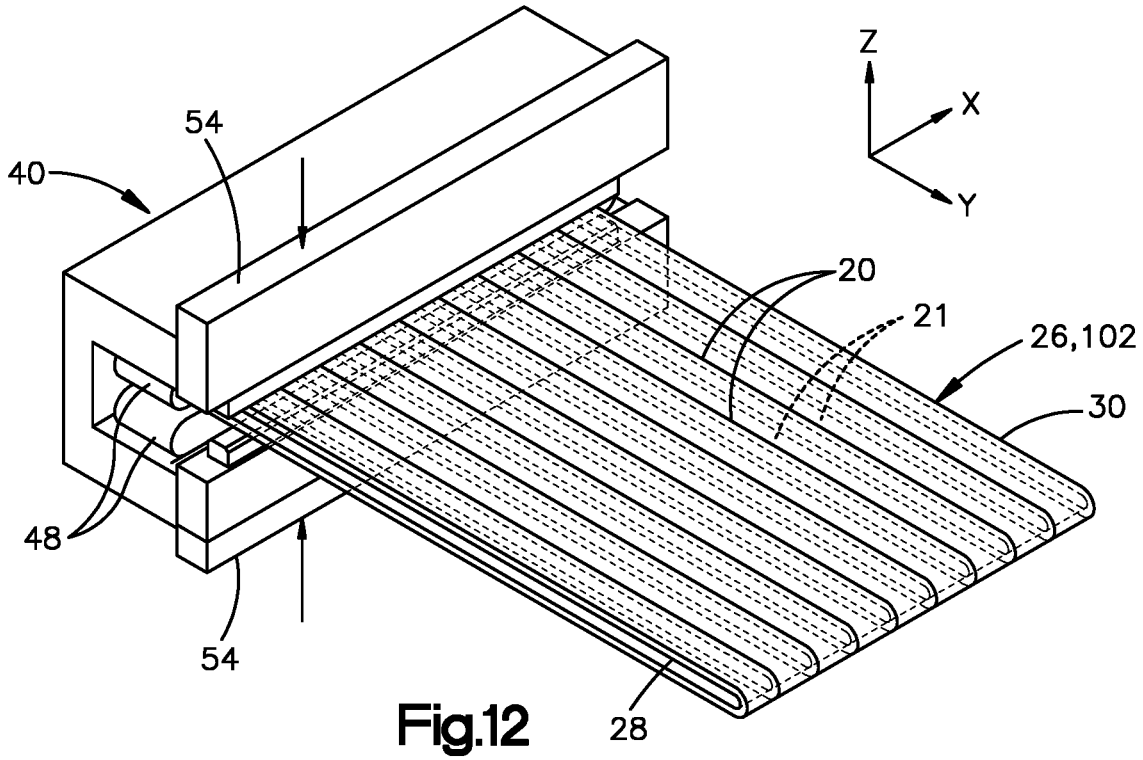
FIG. 12 shows a perspective view of the packaging material of FIGS. 1-11 at an eighth stage for preparing a package with the packaging material, at which stage the packaging material is shown at a third phase of engagement with the inflation and sealing device of FIG. 7.
Figure 13:
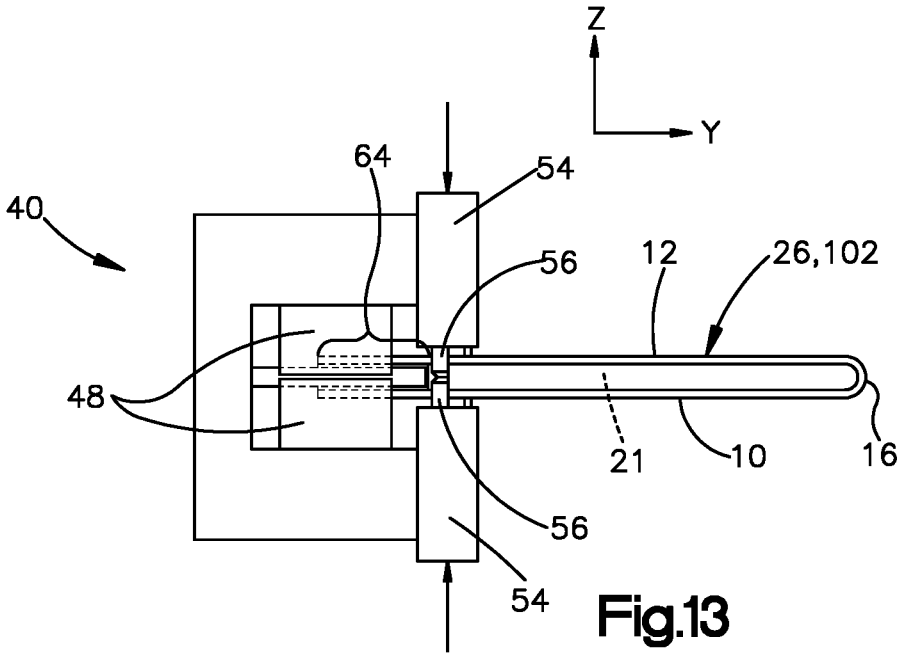
FIG. 13 shows an end view of the package preparation system of FIG. 12.

Referring now to FIGS. 12 and 13, at an eighth stage for preparing a package (which corresponds to a third phase of engagement with the device 40), while the pillow clamps 48 are engaged, the jaws 54 are moved toward one another until the sealing elements 56 are brought into engagement with the lower and upper layers 10, 12 of the package segment 26. Then, the sealing elements 56 form a longitudinal seal 62 (see FIGS. 14-15) between the lower and upper layers 10, 12 of the package segment 26, closing the open side 14 thereof. Preferably, the longitudinal seal 62 extends from the sealed leading end 28 to the sealed trailing end 30 of the package segment 26. Moreover, the longitudinal seal 62 preferably traverses the partitions 20, which individualizes each of the channels 21 (i.e., each channel 21 is individually sealed so as to define a single, closed volume of space). With the channels 21 inflated and individualized, the package segment 26 forms a discrete, durable, inflated packaging cushion 102. The individualized channels 21 provide the packaging cushion 102 with advantageous durability because the inadvertent puncture of rupture of one of the channels 21 is limited to that channel. Additionally, the packaging cushion 102 is customizable in inflation level, as described above, and also customizable in longitudinal length, as described in more detail below.

As mentioned above, the sealing elements 56 extend forwardly around the distal end of the nozzle 46 so that the nozzle 46 remains within the package segment 26 while the final seal of the open side 14 of the package segment is completed. An excess portion 64 of the package segment 26 that extends laterally rearward of the sealing elements 56 during the eighth stage/third phase (and laterally rearward of the longitudinal seal 62 thereafter) can remain coupled to the package segment 26 at the longitudinal seal 62 after the jaws 54 are retracted.

It is to be appreciated that in further embodiments, the jaws 54 can also be movable along the lateral direction Y with respect to the housing 42. In this manner, the jaws 54 can be manipulated so as adjust the lateral location of the longitudinal seal 62, providing for tailored lateral sizing of the channels 21, which sizing can be selected based on the size and/or volume of item(s) to be packaged within the package segment 26. The excess material can optionally be trimmed. The foregoing features can be utilized to reduce the final volume and weight of packages made from the size-tailored package segments 26, which can provide significant cost savings.

Figure 14:
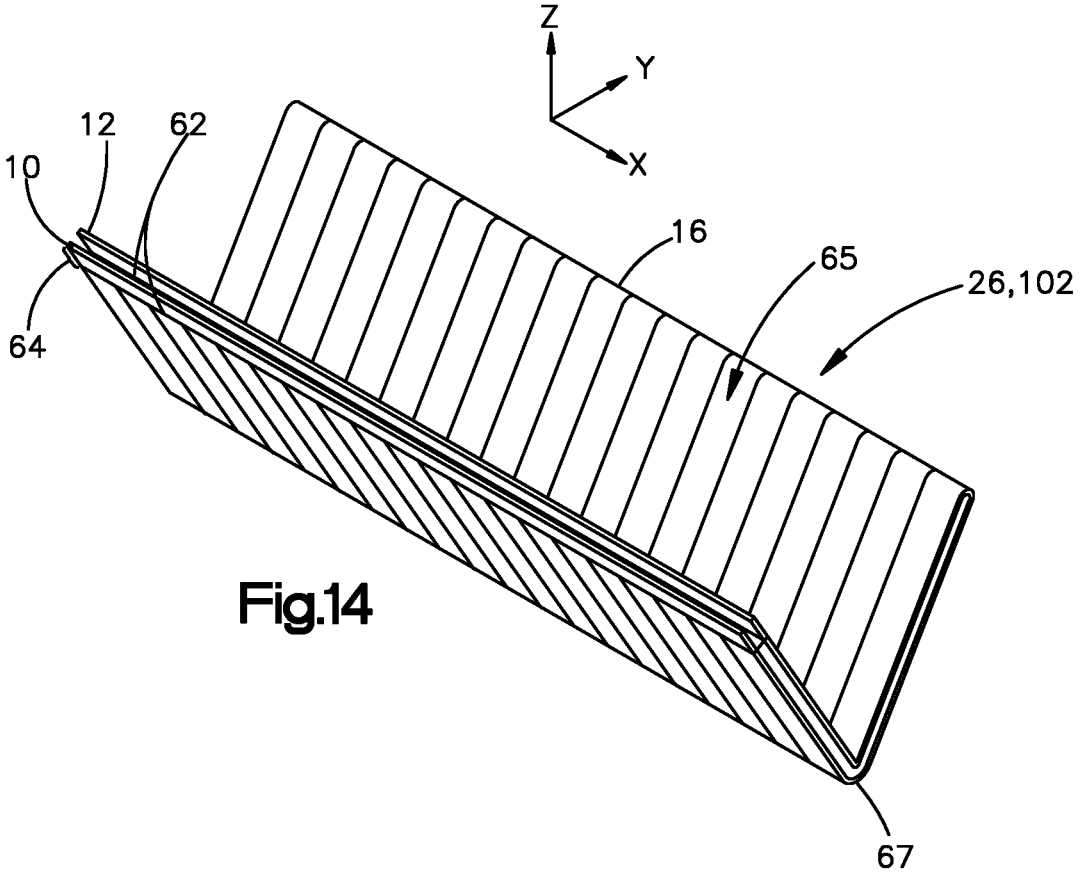
FIG. 14 shows a perspective view of a the packaging material of FIG. 13 induced into a shape for receiving one or more items for packaging, according to an embodiment of the present disclosure.
Figure 15:
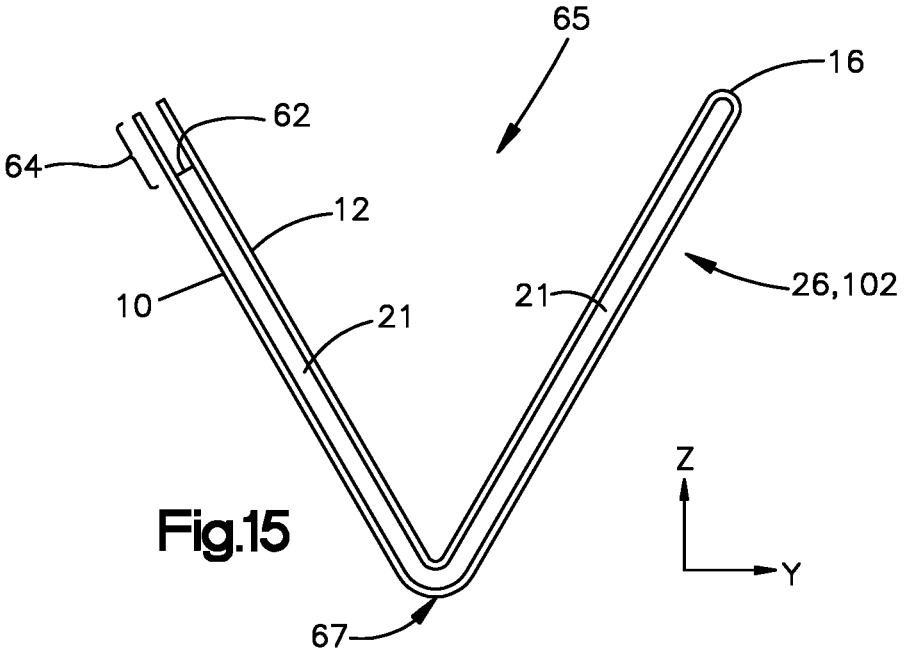
FIG. 15 shows an end view of the packaging material of FIG. 14.

Referring now to FIGS. 14 and 15, at a ninth stage for preparing a package, the package segment 26 can be induced into a shape for receiving one or more items for packaging. Accordingly, the shape can be characterized as a "receiving shape." As shown, the receiving shape can be a V-shape, although other receiving shapes are within the embodiments disclosed herein, such as a U-shape, for example. Preferably, the receiving shape provides the package segment 26 with a top opening 65 into which one or more items can be induced and a closed bottom portion 67 for supporting the item(s) during the ninth stage. The package segment 26 can be induced into the receiving shape via a number of various mechanisms. For example, a shape-inducing element, such as a draw bar, for example, can be lowered against the package segment 26 so as to draw the package segment 26 into the receiving shape. In other embodiments, an item induction bucket can be lowered against the package segment 26 so as to impart the receiving shape to the package segment 26, as described more fully in U.S. patent application Ser. No. 15/891,600, filed Feb. 8, 2018, in the name of Talda et al. (referred to herein as "the Talda Reference"), the entire disclosure of which is incorporated by reference herein. In yet other embodiments, a series of connected package segments 26 can be conveyed along the direction of conveyance X to impinge against a shape-inducing feature, such as a wedge 68 and trough 69 assembly (see FIG. 16), in a manner imparting the receiving shape to the package segments 26 in a continuous motion, as also described more fully in the Talda Reference. As shown in FIGS. 14 and 15, the receiving shape can be transverse to the direction of conveyance X (i.e., at least some of the channels 21 assumes the entire receiving shape), although in other embodiments the receiving shape can be along the direction of direction of conveyance X.

Figure 16:
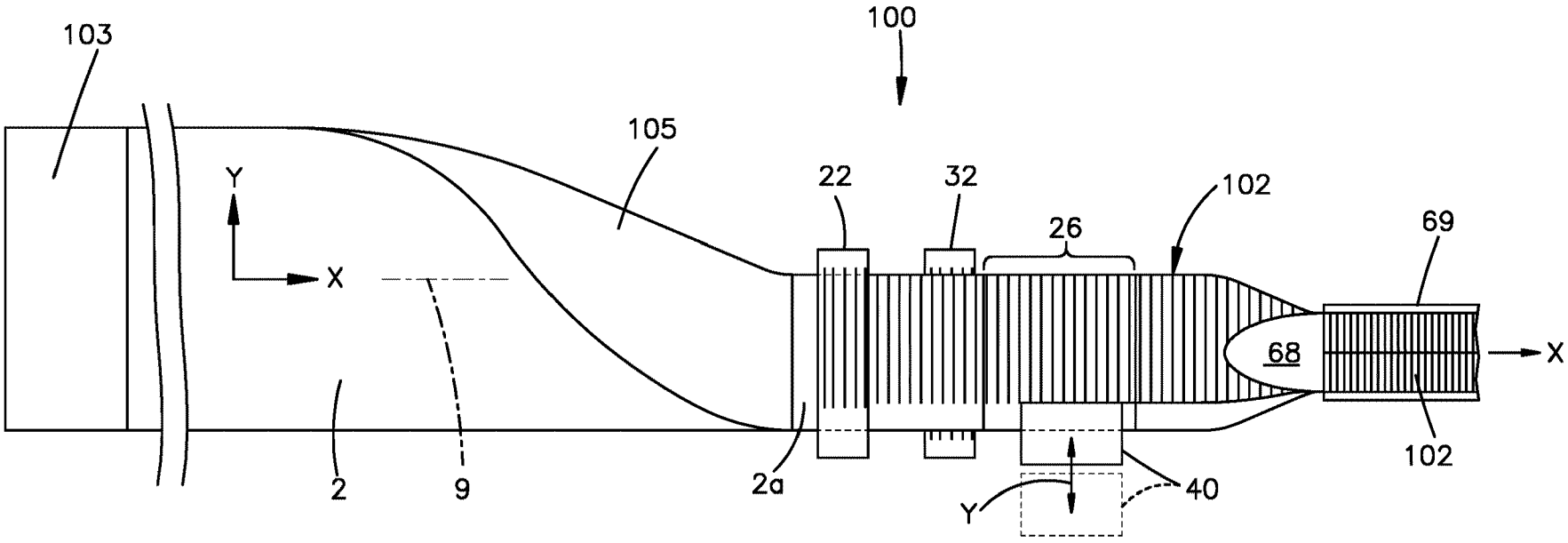
FIG. 16 shows a top plan view of an automated system for preparing size-customizable, inflated packaging cushions for packaging items therein, according to an embodiment of the present disclosure.

Referring now to FIG. 16, an automated packaging material preparation system 100 for preparing customizable, inflated packaging cushions 102 includes a supply, such as a roll 103, of the stock layer of packaging material 2 to be prepared into the packaging cushions 102. The stock material 2 can be unwound from the roll 103 and conveyed along the direction of conveyance X, such as by one or more rollers, for example, to a folding mechanism 105, such as a shaped funnel, for folding the stock material 2 over itself about its longitudinal midline 9 to form the folded packaging material **2*a*. The folded packaging material 2*a* can be subsequently conveyed against the first weld roller 22 to form the partitions 20 (and the channels 21 therebetween), and thereafter conveyed against the second weld roller 32 to form the sealed leading and trailing ends 28, 30 of the respective package segments 26. It is to be appreciated that the relative positions of the first and second weld rollers 22, 32 within the system 100 can be reversed so that the sealed leading and trailing ends 28, 30 are formed prior to the partitions 20 and channels 21**.

After the partitions 20, channels 21, and sealed leading and trailing ends 28, 30 of each package segment 26 are formed, the package segment is conveyed alongside the inflating and sealing device 40, which operates in the manner described above. As shown, the device 40 can translate toward and away from the open side 14 of the package segment along the lateral direction Y. It is to be appreciated, however, that the device 40 can also be configured to travel alongside the package segment 26 along the direction of conveyance X so that the inflation and sealing process is a continuous motion process that does not require halting and restarting conveyance of the package segments 26. In such continuous motion embodiments, the device 40 can be employed in a carousel assembly that includes multiple devices 40 that are configured to travel alongside the open side 14 of the package segment 26. Furthermore, as described above, the device 40 can be configured to inject a variable amount of air into each package segment 26, based on the collective size and/or volume of the item(s) designated for induction therein, as well as the desired cushioning and/or protection characteristics for the item(s). With continued reference to FIG. 16, after the package segment 26 is inflated as desired and sealed to form a discrete inflated packaging cushion 102, the packaging cushion 102 can be conveyed against a shape-inducing feature, such as the wedge 68 and trough 69 assembly, that imparts the receiving shape to the packaging cushion 102.

Figure 17:
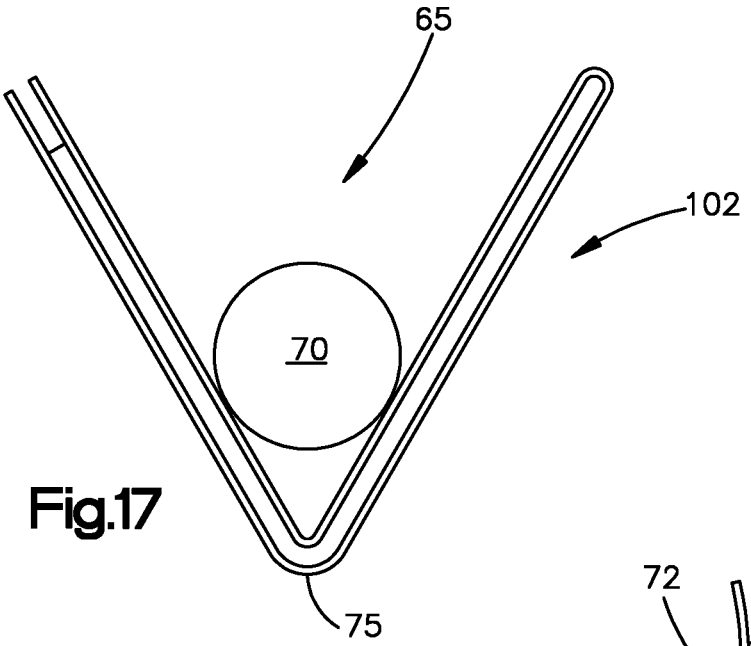
FIG. 17 shows an end view of the packaging material of FIG. 15 with an item inducted therein for packing.

Referring now to FIG. 17, at a tenth stage for preparing a package, one or more items 70 can be inducted into the top opening 65 of the inflated packaging cushion 102. The item(s) 70 can be inducted into the shaped packaging cushions 102 via gravity from one or more containers. In other embodiments, the item(s) 70 can be placed in the shaped packaging cushion 102 by a robotic arm, a shuttle, or another type of induction mechanism. An embodiment for inducting the item(s) 70 into the packaging cushions 102 is described in more detail below.

Figure 18:
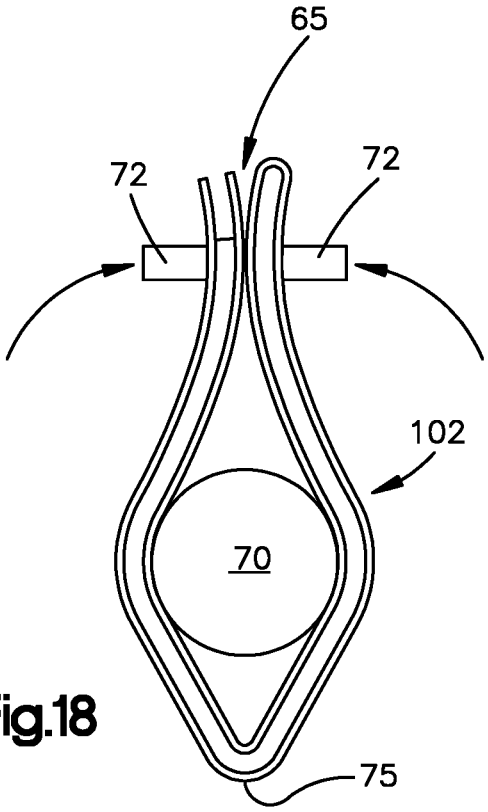
FIG. 18 shows an end view of the packaging material and the item of FIG. 17 with top ends of the packaging material brought together for sealing.

Referring now to FIG. 18, at an eleventh stage for preparing a package, one or more closure elements 72 can move one or both of the laterally opposed top ends of the packaging cushion 102 (i.e., the excess portion 64 and the fold 16) toward the other. As shown, the closure elements 72 can optionally move the upper layer 12 at both top ends of the packaging cushion 102 toward engagement with each other to close the top opening 65. The closure elements 72 can comprise clamps, rollers, or any other mechanism for closing the top opening 65.

Figure 19:
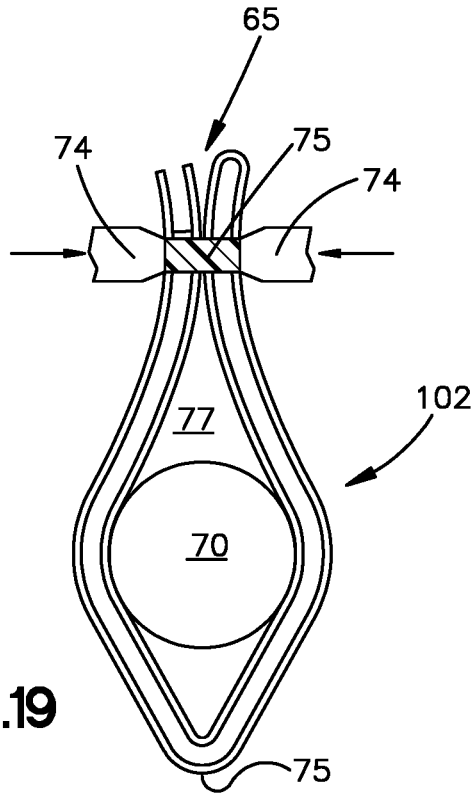
FIG. 19 shows an end view of the packaging material and the item of FIG. 18, with the top ends of the packaging material sealed together, sealing the item in an internal volume defined by the packaging material and its level of inflation.

Referring now to FIG. 19, at a twelfth stage for preparing a package, with the top ends of the packaging cushion 102 in engagement with each other, a sealing mechanism, such as one or more additional ultrasonic or thermal welders 74, can form a sealing weld 75 the top ends of the packaging cushion 102 together into sealing engagement. In this manner, the top opening 65 of the packaging cushion 102 is closed and sealed, with the item(s) 70 located in an internal packaging volume 77 defined by the packaging cushion 102 and its amount of inflation. Thereafter, the laterally opposed leading ends 28 of the packaging cushion 102 can be brought together and sealed, and the laterally opposed trailing ends 30 of the packaging cushion 102 can be brought together and sealed, such as by one or more additional sealing mechanisms.

Figure 20:
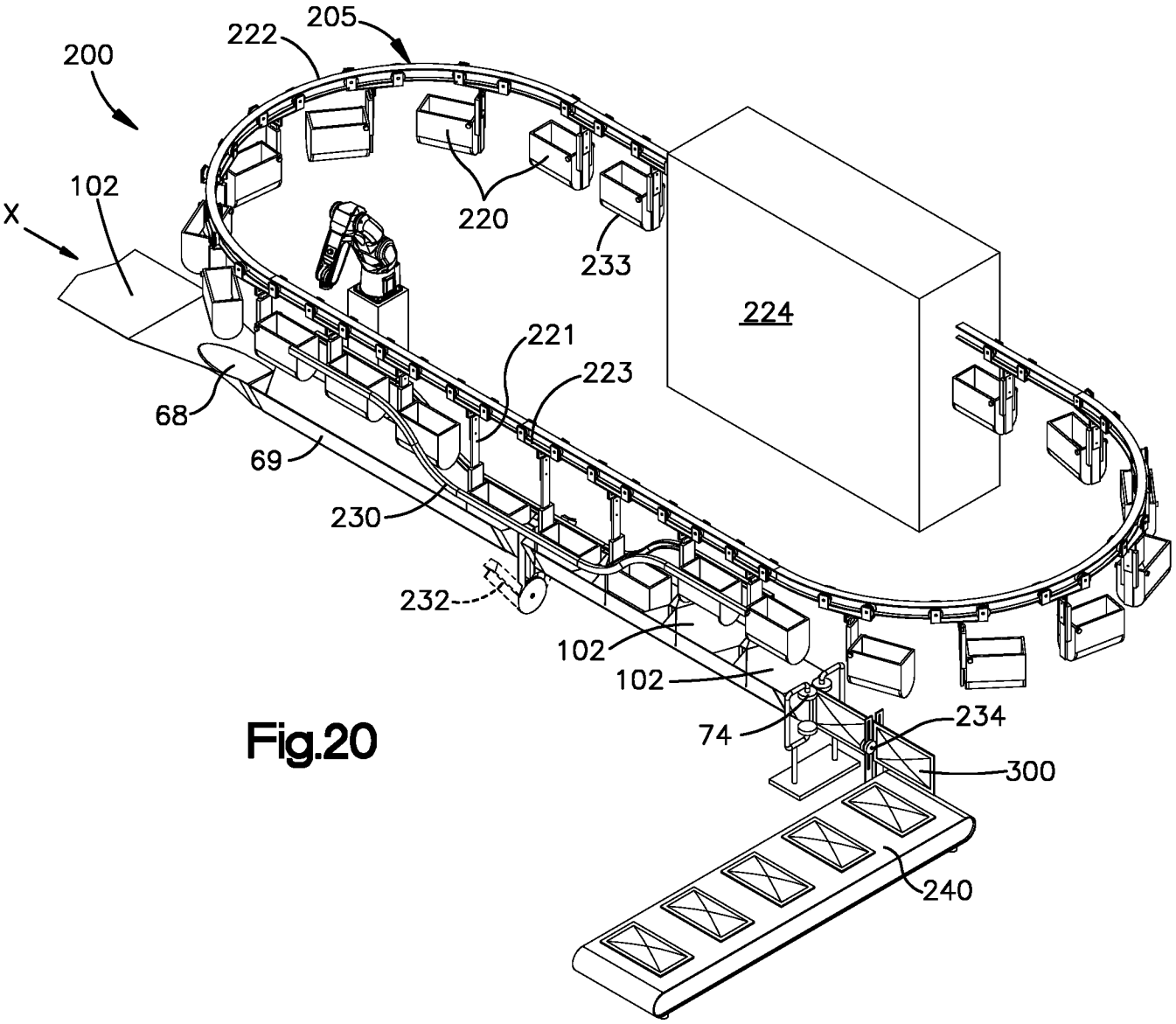
FIG. 20 shows a perspective view of an automated packaging system, according to another embodiment of the present disclosure.

Referring now to FIG. 20, an embodiment of an automated packaging system 200 is described that employs the packaging materials 2, **2*a*, 26, 102 described above. The system 200 can include a container conveyance system, such as a carousel 205, that carries a plurality of buckets 220 along a track 222. The buckets 220 can each be coupled via one or more extendable arms 221 to a carriage 223 that rides along the track 222. The buckets 220 can be directed through an item filling station 224, at which incoming orders of items 70 can be segregated into the buckets 220 that are then conveyed to an induction zone 208 for packaging the items 70. The inflated packaging cushions 102 can be impinged against a shaping element, such as a wedge 68 and trough 69 assembly, as described above. The carousel 205 is preferably configured to convey the buckets 220 along the trough 69 at the same speed as the packaging cushions 102**.

The system 200 can include a secondary induction track 230 that guides one or more followers on each bucket 220 downward to an induction position in which the buckets 220 are positioned within the trough 69. A sealing device, such as a pinch-press welder 232, can form welds sealing the leading and trailing ends 28, 30 of each packaging cushion 102. Subsequently, a bottom opening 233 of the bucket 220 can be opened so that the item(s) 70 therein are gravity-fed into the packaging cushion 102, after which the secondary induction track 230 returns the bucket 200 to its raised position and the bucket 220 is redirected back to the filling station 224. The packaging cushions 102 exit the induction trough 228 and are passed through a sealing element, such as a pair of roller welders 74, which can be configured to seal the top ends of the package segment 26 as described above with reference to FIG. 18. Subsequently, the package segments 26 can be severed by a cutting device 234 into individual, sealed packages 300, which can then be deposited onto an offloading mechanical conveyor line 240.

It is to be appreciated that the automated packaging material preparation system 100 described with reference to FIG. 16 and the automated packaging system 200 described with reference to FIG. 20 can each be a sub-system of a single, unified autonomous packing system for use in a fulfillment center, for example.

It is also to be appreciated that in additional embodiments, the package segments 26 can be inflated after the item(s) are inducted therein. For example, with comparison to the features described in reference to FIGS. 14-19, the package segment 26 can be manipulated into the receiving shape before the channels 21 are inflated and sealed. In such embodiments, the inflating and sealing device 40 can be located downstream of the wedge 68 and trough 69 assembly shown in FIG. 16. The item(s) 70 can be inducted into the shaped package segment, similar to that shown in FIG. 17, and the top ends of the package segment 26 can be brought into contact by one or more closure elements 72, as shown in FIG. 18. However, in the present embodiments, the sealing and inflation device 40 can receive in its internal space 44 the top ends of the package segment 26 such that the nozzle 46 is inserted in the open side 14 of the package segment 26. The pillow clamps 48 can clamp the open side 14 and the fold 16 together while a customized amount of air is injected into the package segment 26 through the nozzle 46. Thereafter, the jaws 54 and the associated sealing elements 56 can seal the inflated channels 21, whereby the channels form individual, sealed compartments. In such embodiments, the partitions 20 optionally need not extend to the fold 16 because the sealing elements 56 can optionally seal the opposite lateral ends of the channels in a single sealing process. It is to be appreciated that yet other arrangements of the devices, systems, and assemblies described above can also be employed for creating size-customization and inflation-customizable packaging cushions.

It is to be appreciated that the use of sequential integers to describe elements or process steps, such as "first" and "second" elements, steps, stages, or phases, for example, does not preclude an intervening element, step, stage, or phase from existing between the sequentially listed items.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above in connection with the respective above-described embodiments may be employed alone or in combination with any of the other embodiments described above. It should further be appreciated that the various alternative embodiments described above with respect to one illustrated embodiment can apply to all embodiments as described herein, unless otherwise indicated. Also, the present invention is not intended to be limited by any description of drawbacks or problems with any prior art device.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

What is claimed is:

1. A system for preparing a package, comprising:

a material configured to be conveyed along a longitudinal direction, the material comprising two folded layers of polymeric film joined at a fold extending along the longitudinal direction, the fold defining a first side of the material opposite an open second side of the material;

a first welding device configured to form partition welds between the two folded layers, the partition welds each extending from the fold to a terminus located inward of the open second side;

a second welding device configured to form first and second seal welds extending from the fold to the open second side, wherein the first and second seal welds are spaced from each by a length along the longitudinal direction, the length traversing a plurality of the partition welds;

an inflation and sealing device comprising:

a nozzle configured for insertion in the open second side; and a pair of opposed clamps each traversing the length, wherein the pair of opposed clamps are inflatable pillow clamps configured to conform to the shape of the nozzle and temporarily seal the open second side of the folded material around the nozzle while the nozzle injects air between the two folded layers so as to inflate interior channels defined between the plurality of partition welds and thereby transition the material to an inflated material.

2. The system of claim 1, wherein the inflation and sealing device further comprises a pair of opposed jaws configured to move toward one another in a manner sealing the open second side of the material.

3. The system of claim 2, wherein at least one of the opposed jaws carries a third welding device for forming a third seal weld traversing the length along the longitudinal direction, wherein the third welding device is an ultrasonic welder, a friction welder, or a thermal welder.

4. The system of claim 3, wherein the third welding device is configured to cause the third seal weld to intersect each of the plurality of partition welds, whereby the inflation and sealing device is configured to seal each of the interior channels after inflation.

5. The system of claim 1, wherein each of the first and second welding devices comprises a weld roller configured to engage the material.

6. The system of claim 5, wherein each weld roller carries a plurality of ultrasonic welders or thermal welders on an outer circumference thereof.

7. The system of claim 1, further comprising a shape-inducing feature downstream of the inflation and sealing device, wherein the shape-inducing feature is configured to impart a shape to the inflated material, wherein the shape defines a closed bottom and an open top.

8. The system of claim 7, wherein the shape-inducing feature comprises a wedge and a trough downstream of the wedge, wherein the wedge is configured to impart its shape to the inflated material and thereafter direct the inflated material into the trough.

9. The system of claim 7, further comprising at least one container configured to deposit one or more items through the open top of the inflated material.

10. The system of claim 9, further comprising one or more closure elements configured to close the open top of the inflated material, so as to at least partially enclose the one or more items in a package defined by the inflated material.

11. The system of claim 10, further comprising one or more additional welding devices for forming a seal weld sealing the top of the package and for forming additional seal welds sealing a longitudinally leading end and a longitudinally trailing end of the package.

* * * * *